United States Patent [19]

McGuire et al.

[11] Patent Number: 4,920,350

[45] Date of Patent: Apr. 24, 1990

[54] SATELLITE TRACKING ANTENNA SYSTEM

[75] Inventors: William H. McGuire, Montgomery, Md.; Thomas J. Tilden, Falls Church, Va.

[73] Assignee: Comsat Telesystems, Inc., Fairfax, Va.

[21] Appl. No.: 224,186

[22] Filed: Jul. 6, 1988

Related U.S. Application Data

[63] Continuation of Ser. No. 89,005, Aug. 20, 1987, which is a continuation of Ser. No. 873,301, Jun. 9, 1986, abandoned, which is a continuation of Ser. No. 581,164, Feb. 17, 1984, abandoned.

[51] Int. Cl.[5] ..... H01Q 1/18; H01Q 3/08

[52] U.S. Cl. ..... 343/709; 343/766; 343/840; 343/872

[58] Field of Search ..... 343/709, 711, 757, 765, 343/766, 840, 872, 888, 882, 705; 342/359; 318/649

[56] References Cited

U.S. PATENT DOCUMENTS

| | | | |
|---|---|---|---|
| 2,740,962 | 4/1956 | Hammond | 343/765 |
| 2,899,677 | 8/1959 | Rockall | 343/765 |
| 3,358,285 | 12/1967 | Van Der Wall et al. | 343/709 |
| 3,911,441 | 10/1975 | Stein | 343/709 |
| 3,984,837 | 10/1976 | Tatnal | 343/872 |
| 4,035,805 | 7/1977 | Mobley | 342/426 |
| 4,304,381 | 12/1981 | Lloyd | 343/765 |
| 4,490,724 | 12/1984 | Bickman | 343/765 |
| 4,596,989 | 6/1986 | Smith et al. | 343/765 |
| 4,680,521 | 7/1987 | Hofman | 343/766 |

FOREIGN PATENT DOCUMENTS

| | | | |
|---|---|---|---|
| 97205 | 6/1984 | Japan | 343/765 |
| 890264 | 2/1962 | United Kingdom | 343/765 |

*Primary Examiner*—Rolf Hille
*Assistant Examiner*—Michael C. Wimer
*Attorney, Agent, or Firm*—Sughrue, Mion, Zinn, Macpeak & Seas

[57] ABSTRACT

A ship borne antenna using a gimballed mount for establishing a two degree of freedom unstabilized structure. A ring is mounted for rotation on a radome and carries an antenna mounted for rotation relative to the ring. The ring antenna are respectively driven by stepper motors. Variations in stability occurring by pitch, yaw or roll of the ship are corrected on a real time basis using a microprocessor that dynamically drives the ring and the antenna to maintain lock-on with a satellite.

12 Claims, 3 Drawing Sheets

SATELLITE TRACKING ANTENNA SYSTEM

This is a continuation of Ser. No. 07/089,005, filed on Aug. 20, 1987 which is a continuation of Ser. No. 06/873,301, filed on June 9, 1986, now abandoned, which is a continuation of Ser. No. 06/581,164, filed on Feb. 17, 1984, now abandoned.

BACKGROUND OF THE INVENTION

This invention relates to an antenna apparatus and in particular to a system for satellite tracking from an unstable platform.

This invention finds specific utilization in a ship borne satellite communication system having an antenna operated to track a satellite despite the motions of a ship.

Maritime communications are designed to provide ship-to-shore, and in some cases ship-to-ship communications, utilizing a communication satellite as a transmitting link. Given the environment of use, off-shore, the satellite antenna tracking system must be capable of prolonged, sustained operation, must be easily maintained and highly reliable.

Such systems first acquire through some form of external inputs as to position the desired communications satellite which is customarily placed in a stationary geosynchronous earth orbit. This requires, at a minimum, satellite elevation and azimuth data. Once the satellite has been acquired, the pointing attitude of the antenna is then continuously updated during the duration of the ship's voyage to maintain lock-on with the satellite irrespective of changes in the ships heading and position. Changes in the heading of the ship are generally automatically compensated in the azimuth axis, typically by direct link to the ship's compass. Position changes are relatively insignificant over short periods of time, for example, in stationkeeping operations. For a geosynchronous satellite, a one hundred mile change in the ship's position represents less than a 2° tracking error, so changes occur gradually relative to changes in the ships position. To maintain lock when distances are traversed a tracking algorithm is used which constantly monitors signal strength and seeks the position at which it is maximized. Due to the nature of the algorithm it can only be used to correct long term errors and not rapid excursions.

A primary difficulty in maintaining lock-on with the satellite is the ship's motion, primarily pitch and roll disturbances. In a heavy sea state, rolling and pitching motion by wave action can be severe and sudden as well as the turning of the ship to a different, often inadvertent change of heading. Each of these motions require a change in the orientation of the antenna to maintain lock-on with the satellite. Additionally, motions of the ship are often quite sudden and therefore can be applied to the antenna with considerable force given its orientation displaced from the axis upon which motions of the ship occur.

It is customary to mount the antenna structure at the highest point on the ship to minimize reflections from the ship's superstructure and from the sea surface. These reflections tend to cause distortions or pertubations in the signals received from the satellite. While mounting at the highest point on the ship minimizes these disturbances and additionally tends to reduce interruption of received or transmitted signals which occur by having the signal path blocked by parts of the ship, the forces applied to the antenna are exacerbated at this location. That is, since the antenna is mounted at a position significantly removed from the origin of the axis of rolling, pitching and yawing of the ship, the actual translation of the antenna is amplified. Moreover, in the context of large vessels having engines, winches and the like, vibration is a factor. Consequently, the antenna structure must be configured to maintain a lock-on with the satellite irrespective of all of these external forces tending to move the antenna suddenly randomly and with great force.

Accepted techniques of maintaining antenna stability have been promised on first establishing a stabilized platform and then mounting the antenna on the stabilized platform. This technique generally uses gravity sensors, gyros, and accelerometers to determine on a real time basis motions of the ship. Gears and the like are then utilized to maintain a platform in a local horizontal plane irrespective of motions of the ship beneath it. The antenna mounted on the platform can then track the satellite irrespective of movement of the ship. This technique is shown with variations in terms of active sensors in U.S. Pat. Nos. 3,893,123, 3,999,184, 4,020,491, 4,035,805, 4,118,707. In these systems with a stabilized pedestal, the antenna is then configured for motion by elevation over azimuth. In such a system, shown in FIG. 1, as the ship rotates under the antenna, the azimuth axis compensates for ship's heading changes. Azimuth axis correction is therefore 360°. Motion in the elevation axis is generally 90°. It can be appreciated that the elevation over azimuth techniques is derived from ground based antenna systems where the mount can be leveled and fixed.

A recognized problem with this system is that as the ship rotates and azimuth corrections are made the connecting feed cables tend to wrap around the antenna mast. In order to continue operations, these cables must be periodically unwrapped by antenna rotation before it can continue tracking the satellite. Thus, a loss in communications results when this unwrapping process occurs.

A more serious problem is the complexity and weight associated with this system. Gravity sensors, accelerometers and gyroscopes used to provide sensor inputs for the stabilized platform are expensive and not considered to be highly reliable elements in the harsh off-shore environment. Moreover, each of the elements must be counterweighted such that the pedestal itself is balanced and then the antenna system on top of the pedestal is also balanced. Such systems tend to be relatively heavy, about 300–400 pounds for the stabilized platform and about 700–800 lbs for the complete system including a 4 ft. antenna including the radome. Given the fact that this entire apparatus is mounted on a pedestal above the ship superstructure, it is then also necessary to, in some cases, reballast the ship to avoid excessive rolling. Given the complexity and weight of such systems, there usage has generally been confined to large ships capable of carrying and supporting such systems.

In an attempt to eliminate complexity, but not necessarily weight, a second technique has been to define a passive stabilized platform upon which the antenna is mounted. Thus, rather than utilizing active sensors on the platform, the pedestal is mounted on a universal joint which is heavily ballasted to establish a pendulum type structure. In order to provide stability along one axis and thereby decouple motion in one direction, it is customary to mount a pair of counterrotating momentum wheels on the pedestal. A pair of momentum wheels is necessary to cancel out the torque which would be generated by the single unit. Such a passive system eliminates the complexity and aspects of unreliability in prior art active systems, however, the weight penalty remains. Moreover, passive stable platform utilizes the same elevation over azimuth motion having the wire wrapping problem as defined relatively to an active stabilized platform.

SUMMARY OF THE INVENTION

Given these deficiencies in the prior art, it is an object of this invention to define a ship borne antenna system which will continuously and accurately attract a satellite irrespective of movement of the ship.

Another object of this invention is to provide a ship borne satellite antenna system that does not require a rewrap cycle to unwind a feed cable wrapped about the pedestal mast.

A further object of this invention is to provide a ship borne antenna system of reduced weight and complexity which finds utilization on a wide range of ocean going vessels.

A still further object of this invention is to provide a ship borne antenna system which is highly reliable and capable of prolonged operation in the open sea.

These and other objects of this invention are attained by utilizing a gimbaled mount for a light weight tracking antenna. The present invention proceeds from a recognition that a stabilized platform is a precursor to provide known reference points for antenna movement. Additionally, by not utilizing an elevation over azimuth tracking system a continuous overhead operation is possible irrespective of whether the antenna is pointing along any principle axis.

In accordance with the present invention, the same two axes of motion used for antenna tracking, that is roll and pitch, are also used to compensate for the lack of a stable platform. Signals indicative of the ships displacement from a horizontal position are fed to a microprocessor which then computes corrections necessary to modify antenna pointing angles. Bearing and elevation data is first received from a serial data link for purposes of antenna-satellite lock-on. Then, roll and pitch data obtained from onboard sensors is provided to the microprocessor to provide the necessary corrections for delay and linear acceleration as a function of ship movement. With these corrected pitch and roll inputs and the required bearing and elevation, the microprocessor then calculates the position of the antenna along two axes utilizing spherical coordinate translation algorithms. The microprocessor then calculates the rate of rotation for each axis needed to move to the required position from the last known position an that axis. Stepper motors are used to drive the system.

This invention will be described in greater detail by referring to the attached drawing and the description of the preferred embodiment which follows.

DESCRIPTION OF THE PREFERRED EMBODIMENT

Figure 1:
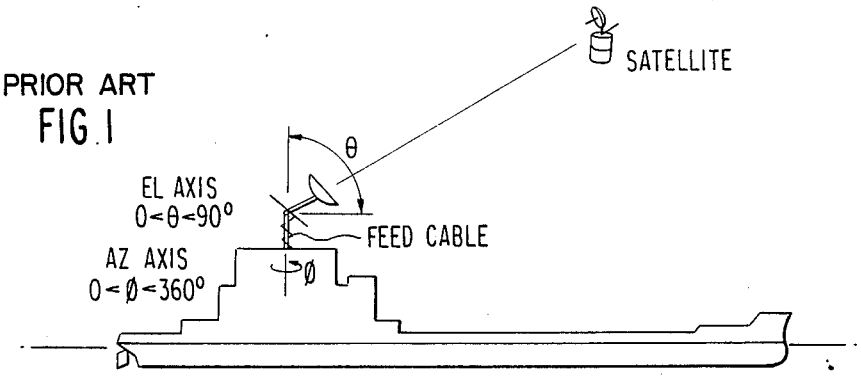
PRIOR ART FIG. 1
FIG. 1 is a schematic elevation view illustrating an antenna ship mounting utilizing a standard elevation over azimuth mount.
Figure 2:
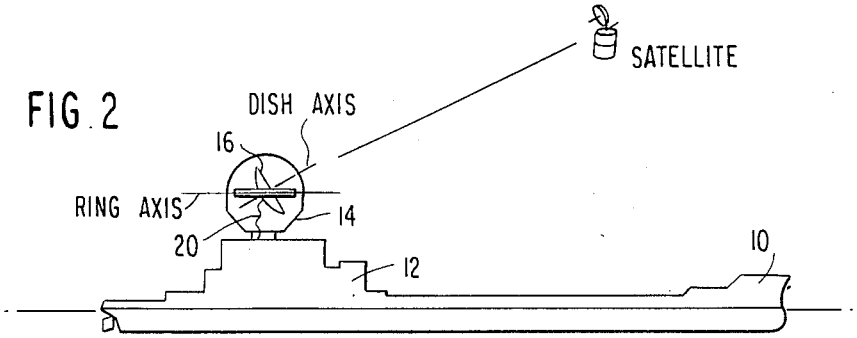
FIG. 2 is a schematic elevation drawing illustrating the gimbled mount in accordance with the present invention.
Figure 3:
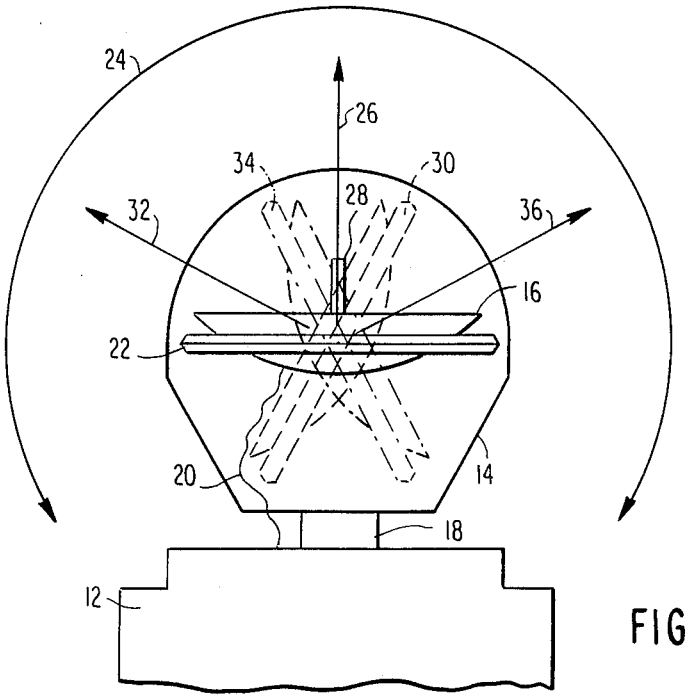
FIG. 3 is a perspective elevation end view of a ship illustrating the definition of the ring axis of rotation of the antenna system.
Figure 4:
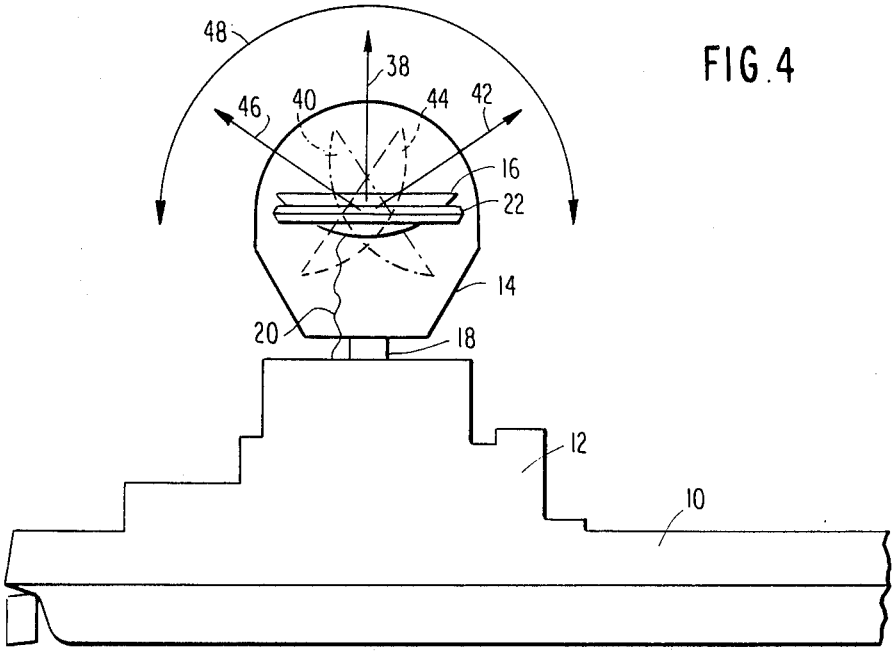
FIG. 4 is a schematic elevation sideview illustrating the dish axis of rotation of the antenna system of this invention.

Referring now to FIGS. 2, 3 and 4, the antenna system of this invention will first be described relative to the respective axis of movement.

A ship 10 having a superstructure 12 carries a radome 14 to position an antenna 16 at the highest possible point to minimize interference by reflection and the like. The radome 14 is generally fixed to the ship by means of an antenna mast 18. It is understood that in FIGS. 2, 3 and 4 the radome is shown grossly out of scale to illustrate the antenna disposed therein. In practice, in accordance with the present invention, the radome 14 would be only so large as necessary to house and allow for movement of a dish 14, typically 48 inches in diameter.

A feed cable 20 provides the electronic link between the ship onboard electronics and the antenna electronics. The cable merely hangs from the diplexer fixed to the back of the dish 14.

In accordance with the present invention, the antenna 16 is mounted in a gimbal mount configuration allowing free movement along two axis. That is, the antenna design in accordance with the present invention has two primary axes. These are designated as the ring axis of FIG. 3 and the dish axis of FIG. 4. With the ship steady and level, these two axis can point to any position in the sky with only 180° motion required of either axis. This primary mode of movement is distinguishable from the elevation over azimuth mount which utilizes 90° of elevation motion and 360° of azimuth. This difference allows the gimbal mount of the present invention to eliminate the problem of rewrapping since both axes are used for compensation. Because the antenna must always point upward, the cable merely hangs down. The antenna does not rotate relative to the ship and therefore no rewrap cycle is required.

A ring 22 is mounted onto the radome 14 and is aligned parallel to the lubber line of the ship. Thus, as shown in FIG. 3, the ring axis is disposed orthogonal to the plane of the drawing running the length of the ship. Rotation about this axis shown by the the arrows 24 allows not only for 180° rotation, but also a full 45° depression in either direction to compensate for severe rolling of the ship.

As shown in FIG. 3, arrow 26 dipicts the position of the antenna feed 28 with the ring 22 aligned horizontally. Assuming the antenna 16 remaining stationary relative to the ring 22, if the ring then rotates counterclockwise to an orientation shown in dotted lines 30, the orientations of feed will be in the direction of the arrow 32. If the ring 22 rotates clockwise, again with the dish remaining stationary relative to the ring, it assumes a position shown via dotted lines 34. The direction of the feed would then be represented by the arrows 36. It can thus be appreciated that by movement of the ring 22 along the arcuate path shown by arrows 24, the positioning of the dish 16 relative to any change in the ship's roll axis can be effectuated to maintain a stable pointing angles vis-a-vis a fixed position in the sky, i.e. a synchronous satellite.

Referring now to FIG. 4, the dish axis, that is the axis of movement of the parabolic reflector 16 is illustrated. As will be described herein, the parabolic reflector dish 16 is mounted on the ring 22 and carries with it a motor for motion relative to the ring 22. Consequently, a dish axis of rotation is established orthogonal to the ring axis. The dish axis runs athrawtship.

With the dish axis parallel to the ship, the feed 28 would point directly vertical as shown by arrow 38. If, however, the dish 16 were to be rotated clockwise, as shown by the dotted lines 40, the feed would point in the direction represented by arrow 42. If the dish 16 is rotated along the dish axis in a counterclockwise direction, as shown by the dotted line position 44, the feed 28 would point in the direction of arrow 46. It can therefore be appreciated that the dish axis defines 180° over the top motion shown by the arrow 48. Motion along the dish axis therefore compensates for pitch motion of the ship.

Figure 6:
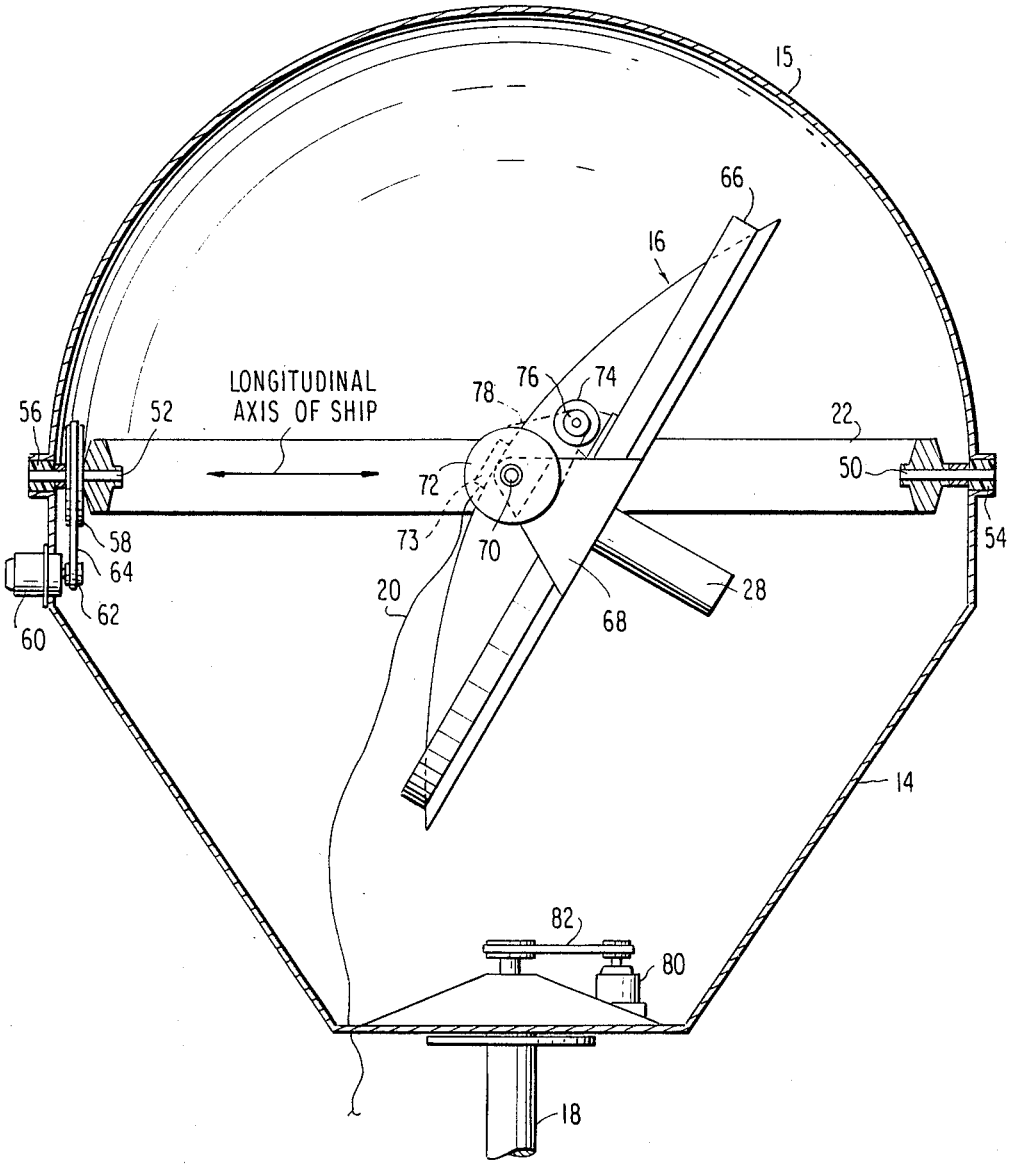
FIG. 6 is a schematic elevation view illustrating the components of the antenna system of this invention.

Referring now to FIG. 6, the essential components of the antenna system of this invention are illustrated. The radome comprises two sections, a lower section 14 and a compatible mating upper section 15. The radome is generally made of plastic or fiberglass and provides an environmental protective shell for the antenna components therein. The radome is mounted on mast 18 generally positioned on the ship's superstructure. A fiberglass ring 22 is journaled for rotation relative to the radome upper section 15. That is, as shown in FIG. 6, the ring 22 has at each end a pair of bearings 50, 52 which are respectively journaled for rotation in bearings 54, 56. The bearings are nonmetallic teflon on plastic. The ring 22 may be a solid or a hollow fiberglass ring configured to handle the load of the parabolic dish 16 and its associated equipment in a stable manner. That is, the ring 14 is configured to withstand the necessary vibration and shock loadings imposed by motion of the ship as well as movement of the dish 16 in a stable manner without flexing. A hollow hexagonal shape is shown in FIG. 3, it being understood that any high strength-to-weight ratio structure can be configured for the ring 22. Shaft 52 carries with it a gear 58. A stepper motor 60 is mounted to the radome shell portion 15 for rotating a second gear 62. A belt 64 is used as a transmission mechanism to convert motion of the motor 60 into rotation of the ring 22 via gears 58 and 62.

While not illustrated, it is appreciated that the stepper motor 60 will be housed in an environmentally secure structure. While a belt drive is shown other known drive techniques may be employed. Also, the stepper motors may be replaced with other known types of motors, for example, servo motors may be employed. Also, the stepper motors may be replaced with other known types of motors, for example, servo motors may be employed.

The parabolic dish 16 is preferably made of graphite fiberglass fibers to provide a temperature stable conductive surface requiring no additional coatings. Typically, such dishes are approximately 48 inches in diameter. Dish 16 has a flanged circumferential backing structure 66 to provide the necessary structural strength for mounting the dish 16 onto the ring 22. A pair of mounting brackets 68 couple the dish 16 and its integral flange 66 to the ring 22 via shafts 70. It will therefore be appreciated that the axis of the shafts 70 define the dish axis. The dish then mounts inside the ring and is journaled for movement relative to the ring. As the ring is rotated the dish is similarly rotated. A two degree of freedom gimbal mount is therefore defined.

In accordance with known communication antennas, dish 16 also carries a feed 28 disposed at its geometric center. The feed 28 comprises a helical head. The geometric configuration of the dish 16 and the feed 28 are well known and established in this technology. Mounted on shaft 70 is a gear 72. A second stepper motor 74 carrying with it a gear 76 drives the dish 16 about the dish axis utilizing belt 78 as a transmission mechanism. Stepper motor 74 mounted on the dish 16 therefore "pulls" the dish about the dish axis during rotation. It will be appreciated that other techniques of driving the dish relative to the ring may be employed. Also shown in FIG. 6 are the associated diplexer electronics 73 providing the electronic coupling between the antenna and its feed to ship onboard electronics. The diplexer 73 is mounted to the back of the dish 16 in a position to allow static balancing of the motor 74 and its associated gear 76. Consequently, the diplexer also acts as a counterweight for the motor allowing static balancing without the need of additional weights. It is apparent that while offering advantages mounted as described, the diplexer can be mounted elsewhere.

Wiring for the stepper motor 74 is carried on the ring to an appropriate position and then routed externally with the associated leads for the stepper motor 60. The antenna wiring from the diplexer merely hangs from the antenna. Given the fact that there is no continuous rotational movement about pedestal 18, it will be appreciated that no wrapping of the wire 20 occurs relative to either the pedestal, the ring or the dish. Consequently, the problem of wiring wrap and the attendant rewrap cycles are eliminated by this invention.

The all up weight of the structure shown in FIG. 6 exclusive of the mast 18 is in the order of 50 lbs. It is appreciated that this is approximately a ten-fold decrease relative to the weight of prior art systems. This significant decrease in weight is important since it minimizes if not eliminates the requirement for additional ballasting to trim out a ship. Importantly, given the antennas reduced weight, it can be carried by smaller vessels. Fishing vessels and larger yachts can therefore realize offshore satellite communication capability heretofore unknown.

Another advantage of the present invention is that given its weight, installation is materially simplified. The prior art systems require cranes, or in some case helicopters, to lift the antenna system and position it on the mast 18. The present invention in contrast, can easily be positioned by two people. Moreover, given the elimination of the requirement of the stable platform, the attendant accelerometers, gravity sensors and gyros located on the platform, the entire device is materially simplified. Reliability is therefore enhanced.

In operation, the dome is positioned on the mast 18 with the ring axis aligned parallel with the ship's lubber line. The device is leveled relative to the static trim of the ship. The motors 60 and 74 are stepper motors of conventional design utilizing optical encoders to provide positive feedback of stepper motor rotation. Such stepper motors are known per se and have been proposed for driving the stabilized platform of prior art devices to compensate pitch and roll movements (see, U.S. Pat. No. 4,035,805).

The stepper motors 66 and 74 are initially driven under computer control to zero position end points so that an initial position of both the ring and dish are established, though actual antenna position can be determined in other ways, such as feedback devices. The position of the ship in terms of latitude and longitude coordinates are then fed into a first microprocessor. This data comes from external inputs such as LORAN or NAVSAT receivers. This processor typically a Zilog Z-80 microprocessor also receives as a second input satellite position data and converts these inputs into bearing and elevation signals to initially orient the dish. The initial bearing and elevation data signals are also used as input to a second microprocessor, also a Z-80 which receives real time pitch and roll data from sensors located onboard the ship. Pitch and roll sensors, not shown, are, in accordance with the present invention, not positioned on the antenna system but rather housed on-board to provide data directly responsible to ship motion.

The second microprocessor receiving bearing and elevation data together with pitch and roll data then performs a coordinate translation utilizing spherical coordinates. The translation routines may be written in Z-80 machine language employing high speed algorithms for determining trigonometric functions when needed. The thus assembled machine language routines are stored in read only memories (ROM) connected to the Z-80 microprocessor. The outputs are signals to the stepper motors 60 and 74 to drive the ring 22 and the dish 16 to lock-on for satellite acquisition. Thereafter, the second microprocessor receiving pitch and roll data on a real time basis continually updates dish position by providing continuous signals to the stepper motors for positive tracking.

Consequently, as can be appreciated, a two-axis stabilized system about pitch and roll is defined utilizing the present invention without the necessity of stabilized platform to mount the antenna. The use of the microprocessors eliminates the prior art requirements for first defining and maintaining a stable platform and then, providing elevation over azimuth data for driving the dish mounted on the platform. Rather, a dynamic system is defined herein for continuously driving the dish utilizing a gimbaled mount.

An advantage of utilizing a motor for driving the system in continuous operation is that greater reliability is achieved. It has been found that motors used to provide stable platforms tend to develop flat spots given the fact that motion, especially pitch correction, occurs over a very limited bandwidth and that all motors are not continuously in operation. However, that reliability is enhanced by continuously driving stepper motors to avoid flat spots and seizing as a function of bearing failure and lubricant dissipation.

Figure 5:
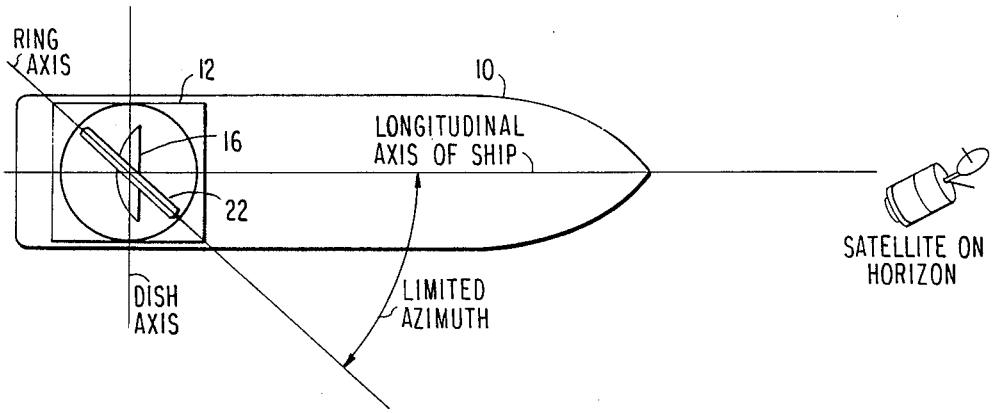
FIG. 5 is a schematic plan view illustrating limited third axis motion for azimuth correction to account for a special condition where the satellite is low on the horizon and directly aligned with the longitudinal axis of the ship and the ring axis of this system.

Thus, a ship is generally continuously undergoing incremental motion. When the ship is pitching, rolling and yawing, stabilization is provided by read-outs from on board sensors and corrections are continuously made given the finite movement possible with stepper motor actuation. Roll motion up to a required 30° may be compensated directly by the ring axis which is normally aligned with the roll axis of the ship. However, in rare situations the satellite may be on the horizon requiring that the ring axis be depressed at least 30°. This depression is shown in FIG. 5. Compensation for pitch motion, up to 15° is more complicated because the dish axis will not directly compensate for pitch as the ring axis does for roll. Rather, a combination of ring and dish axis motion is required for pitch motion compensation. While the dish axis motion is small, the roll action motion is dependent on the bearing of the satellite from the ship. For example, when the satellite is low on the horizon, and directly aligned with the ring axis, a full 360° of motion could be required of the ring axis for minor changes in azimuth and yaw.

In order to prevent this motion, the present invention allows for a limited motion about the azimuth axis. As shown in FIG. 5, a condition may exist where the satellite lies directly on the ring axis. In order to prevent this situation, potentially requiring a full 360° of motion of the ring axis to continuously align itself, a technique is used to allow for incremental changes. Specifically, rotation of the entire dome 14 occurs to a limited extent. As shown in FIG. 6, a third motor 80 is provided and coupled via gear mechanism 82, mounted on the pedestal 18, for driving the entire dome 14 to move the ring axis away from the satellite direction. Other mechanical arrangements to produce this rotational motion are possible Also the motor need not be in the azimuthal direction; elevating the axis by tilting the dome is also possible. The main point is that the axis is moved from the line to the satellite. This limited movement in the azimuth direction is shown in FIG. 5. The axis is limited to approximately 40°. Given this limitation, it is appreciated that the ring axis must sometimes pass through the direction of the satellite in order to affirmatively move away from it. When such motion is required, the action is timed so that the satellite is above the plane of the ship when third axis motion occurs.

Given the availability of motion in the third axis, the total required motion of the ring axis can therefore be limited to approximately 270°, that is with 45° of depression on either side of the horizontal.

It is appreciated that other modifications of this invention may be practiced without departing from the essential scope of this invention. While this invention has been described in use relative to a ship it is apparent that it may be used in other vehicles or environments of use where motion influences tracking ability. Also, while a dish antenna is illustrated, this invention can be used with other types of antenna structure, for example a helical antenna or the like.

We claim:

1. A satellite tracking system comprising:

a radome mount fixed to an unstabilized movable structure;

a ring journalled for rotation on said mount and arrange such that the axis of rotation of said ring is aligned with a principal longitudinal axis of said structure;

means for rotating said ring relative to said mount comprising a stepper motor fixed to a wall of said radome mount, and gear means inside said radome mount for converting stepper motor movement into rotation of said ring;

an antenna journalled for rotation on said ring, said antenna contained in said ring and having an axis of rotation substantially perpendicular to the axis of rotation of said ring; and means for rotating said antenna relative to said ring.

2. The system of claim 1 wherein said means for rotating said antenna comprises a stepper motor fixed to said antenna and gear means for converting stepper motor movement into rotation of said antenna relative to said ring.

3. The system of claim 2 further comprising a diplexer for said antenna mounted on the back of said antenna to counterbalance said stepper motor fixed to said antenna and said gear means.

4. The system of claim 2, further comprising a circumferential flange on said antenna, opposed brackets mounted on said flange and, shafts coupling said brackets to said ring to permit antenna rotation relative to said ring, said gear means comprising at least one gear mounted on one of said shafts and rotating with said antenna.

5. The system of claim 1 wherein said antenna comprises a parabolic dish, said dish formed from graphite fiberglass without any additional conductive layer.

6. The system of claim 1 further comprising means for rotating said radome mount relative to said unstabilized movable structure.

7. The system of claim 6 wherein said means for rotating said radome mount comprises a motor fixed to said mount, a shaft coupling said mount to said unstabilized movable structure and gear means coupling said motor to said shaft.

8. A satellite tracking system comprising:

an unstabilized radome housing carried by a movable structure;

a platform mounted in said radome housing and journalled for rotation about a first axis, means for rotating said platform relative to said radome housing;

an antenna mounted on said platform and journalled for rotation relative to said platform along a second axis; and means for rotating said antenna relative to said platform, said means for rotating said antenna comprising a stepper motor fixed to said antenna, bearing means mounted in the walls of said radome housing for supporting said platform, said means for rotating said platform being fixed to said radome housing including gear means inside said radome for converting stepper motor movement for rotating said platform on said bearing means relative to said radome housing.

9. The tracking system of claim 8 wherein said platform comprises a ring and said antenna is mounted inside said ring.

10. The tracking system of claim 8 further comprising means to move said unstabilized housing relative to said movable structure, said movable structure comprising a ship.

11. The tracking system of claim 8 wherein said stepper motor is mounted on said antenna and a diplexer is mounted on said antenna to counterbalance said stepper motor.

12. A satellite tracking system comprising:

a mount fixed to an unstabilized movable structure;

a ring journalled for rotation on said mount and arranged such that the axis of rotation of said ring is aligned with a principal longitudinal axis of said structure;

an antenna journalled for rotation on said ring, said antenna contained in said ring and having an axis of rotation substantially perpendicular to the axis of rotation of said ring; and a stepper motor fixed to said antenna, gear means for converting stepper motor movement into rotation of said antenna relative to said ring;

a circumferential flange on said antenna, opposed brackets mounted on said flange and, shafts coupling said brackets to said ring to permit antenna rotation relative to said ring, said gear means comprising at least one gear mounted on one of said shafts and rotating with said antenna.

* * * * *